United States Patent [19]

Paton et al.

[11] 4,414,672

[45] Nov. 8, 1983

[54] PLASMA-ARC FURNACE

[75] Inventors: Boris E. Paton; Jury V. Latash; Oleg S. Zabarilo; Gary A. Melnik; Nikolai I. Zamulo; Anatoly A. Zhdanovsky; Alfred I. Bukalo; Vladimir V. Goncharenko; Stanislav S. Ivanchenko; Anatoly R. Slobodian, all of Kiev; Sergei P. Bakumenko; Mikhail K. Zakamarkin, both of Izhevsk, all of U.S.S.R.

[73] Assignee: Institut Elektrosvarki Imeni E. O. Patona Akademii Nauk Ukrainskoi SSR, Kiev, U.S.S.R.

[21] Appl. No.: 302,690

[22] Filed: Sep. 15, 1981

[51] Int. Cl.[3] ..... H05B 7/00; H05H 1/00

[52] U.S. Cl. ..... 373/22

[58] Field of Search ..... 373/103, 102, 22–25, 373/18

[56] References Cited

U.S. PATENT DOCUMENTS

| | | | |
|---|---|---|---|
| 1,983,544 | 12/1934 | Ingelsrud | 373/103 |
| 3,147,329 | 9/1964 | Gage | 373/22 |
| 3,366,725 | 1/1968 | Watterson | 373/103 |
| 3,483,300 | 12/1969 | McGee | 373/103 |

*Primary Examiner*—Roy N. Envall, Jr.

*Attorney, Agent, or Firm*—Fleit, Jacobson, Cohn & Price

[57] ABSTRACT

A plasma-arc furnace comprises a casing with plasma torches, particularly three torches, mounted therewithin in symmetrical relationship relative to the vertical axis thereof. Each of these torches comprises a body provided with a nozzle and an axial conduit for feeding a plasma-forming gas therethrough, and a cylindrical electrode disposed within said conduit. According to the invention, the distance between the centers of working ends of electrodes disposed within adjacent plasma torches is not more than 15 diameters of the electrode.

1 Claim, 4 Drawing Figures

PLASMA-ARC FURNACE

BACKGROUND OF THE INVENTION

1. Field of the Invention

The present invention relates to special metallurgy, and, in particular, to plasma metallurgy, and is particularly concerned with the design of a plasma-arc furnace.

The invention may prove most advantageous in the manufacture of plasma-arc furnaces provided with ceramic lining, furnaces having slag lining, furnaces provided with a water-cooled mould etc. It may be utilized in all the cases where it is necessary to carry out melting and remelting metals, heating and fusing ingots, rolled stock, forgings and other metallic blanks, said operations being carried out either in air or in a controlled atmosphere to eliminate defects of the surface layer thereof.

2. Description of the Prior Art

Plasma-arc furnaces provided either with DC or AC plasma torches are used at present for melting, remelting, heating and fusing metals. Furnaces having AC plasma torches are most generally employed since the use of such torches, as compared with DC torches ensures numerous advantages, the main among them being the following:

absence of magnetic interaction between plasma arcs of adjacent torches, said interaction resulting in a decrease in the furnace efficiency and in damaging the torches;

lower cost and simplicity of power supplies;

low tendency to double arc formation which hereinafter means transfer of a plasma arc to the torch nozzle, due to which fact the arc burns not only between the torch electrode and the metal being heated, but also between the electrode and the nozzle, thereby resulting in a decrease in the service life of the latter, and in a drop in the furnace efficiency.

Alongside with the above advantages, furnaces provided with AC plasma torches, especially single-phase torches, feature some disadvantages, among them first of all a low stability of burning of plasma arcs. In such furnaces, a single-phase AC power supply is connected to an electrode of the plasma torch and to a hearth electrode being in contact with the metal being heated. Instability of arc burning between electrodes is expressed in burning interruptions caused by repeated changing in electrode polarity in the course of the AC current flow. This fact results in significant difficulties when carrying out numerous metallurgical processes where it is necessary to ensure reliable arc-striking during each half-cycle of the current flow with a significant (in the order of 1 m) arc length.

Plasma arc length is further used to mean a magnitude corresponding to a distance from the working end of the plasma torch electrode to a surface being treated.

Known in the art are plasma-arc furnaces provided with single-phase AC torches, wherein in order to improve the stability of arc burning are applied additional high-voltage power supplies generating high-frequency electric oscillations which are superposed on the AC current of the main power supply at the moment when the strength of current is close to zero (see A. V. Donskoy, V. S. Klubnikin, Elektroplazmennye protsessy i ustanovki v mashinostroyenii, Leningrad, "Mashinostroyenie", Leningradskoye otdelenie, 1979, p.99). It is obvious that the presence of additional power supplies results in the design complication and increases the cost of the plasma-arc furnace.

Also known in the art are furnaces of another type, wherein an attempt is made to increase the stability of a single-phase AC arc burning by using a plasma jet obtained as a result of heating a plasma-forming gas being fed to the torch by a pilot DC arc which is ignited between the electrode and the torch nozzle (see G. A. Farnasov, A. G. Fridman, V. N. Karinsky, Plazmennaya plavka, Moscow, "Metallurgiya", 1968, p. 83, FIG. 41, and M. F. Zhukov, V. Ya. Smolkov, B. A. Uryukov, Elektrodugovye nagrevateli taka (plazmotrony), Moscow, "Nauka", 1973, p. 40–41). In order to generate a pilot arc, an additional power supply is connected to the electrode and the nozzle of the plasma torch, namely a DC power supply. The plasma jet provides for constant ionization of the interelectrode space (between the torch electrode and the metal being heated), thereby promoting an increase in the stability of main arc burning.

The presence of an additional power supply in such furnaces, however, results in significant complication of their design. Besides, in the furnaces of the both abovementioned types stabilization of arc burning can be achieved only with a relatively small arc length (not more than 200 mm) since for an arc of a greater length the furnaces of the first type will require complicated, expensive and dangerous in operation high-voltage power supplies, while in the furnaces of the second type stabilization by means of a plasma jet is practically impossible because of a low efficiency of the plasma jet. The low efficiency is caused, in particular, by high losses in the thermal energy which is removed together with water cooling the torch nozzle, and is dissipated by means of radiation and convection into the surrounding space.

More effective is a plasma-arc furnace with a three-phase connection of plasma torches (U.S. Pat. No. 3,147,329). This furnace comprises a casing with plasma torches mounted therewithin in a symmetrical relationship relative to the vertical axis thereof, each of said torches having a body provided with a nozzle and an axial conduit for feeding plasma-forming gas, and a cylindrical electrode disposed within said conduit for connection to a three-phase power supply. Moreover, in the given furnace, similar to those above described, there is provided a DC power supply for striking pilot arcs.

Three-phase connection of the plasma torches makes it possible to eliminate the hearth electrode and to further reduce the tendency of the torches to double arc formation. Such a connection also allows the power supplied to the metal being heated to be increased, thereby upgrading the efficiency and intensifying the technological process.

At the same time, in the operation of the above furnace there arise some serious difficulties. It should be noted first of all that the pilot arc ionizes the plasma-forming gas only within a relatively small portion of the main arc near the electrode of the plasma torch at the moment when the strength of current of the main arc is close to zero. The major portion of the gas column of the main arc within the space between the torch nozzle and the metal being heated is not ionized by the pilot arc since the power and the efficiency of the plasma jet generated by the pilot arc are relatively small.

At the moment when the current and voltage of the main plasma arc (AC current arc) reach zero values, the renewal of the energy dissipated from the column of the main arc into surrounding space is stopped, thereby resulting in the development of deionization processes within the interelectrode space of this arc. Since the problem of optimum mutual disposition of torches in said furnace is not solved, the conductivity of the interelectrode space in the majority of cases is lowered to such an extent that the ignition of arc during the next half-cycle of the current flow becomes either very difficult or impossible.

It should be also noted that in the course of burning of a pilot arc between the electrode and the torch nozzle there occurs an intensive heating of an interlayer of cold gas at the nozzle walls, said interlayer acting as electro- and thermal insulation between the plasma flow and the walls of the nozzle conduit. This heating results in a sharp deterioration of electric insulating properties of said gas interlayer, thereby causing gradual damage of the nozzle in throwing the arc thereon, and leads to the deterioration of thermal insulating properties of said interlayer, which fact also promotes the damage of the nozzle due to intensive heating thereof. A double arc appears, said arc burning in one area between the electrode and the torch nozzle and in other area between the nozzle and the metal being heated due to which fact the nozzle is subjected to the effect of concentrated energy generated by the main and pilot arc.

Finally, it is to be noted that the need in pilot arcs results in complication of the power supply circuit and the circuit for controlling the torches, and requires intensification of cooling the nozzles of these torches.

All the above difficulties inhibit wide utilization of the above described plasma-arc furnace.

SUMMARY OF THE INVENTION

The main object of the present invention is to provide a plasma-arc furnace, wherein stability of plasma arc burning would be increased, especially with a considerable length of said arcs, without increasing the wear of plasma torch nozzles.

The next object of the present invention is to provide a plasma-arc furnace ensuring high quality of plasma-arc treatment of metals.

Another object of the present invention is to provide a plasma-arc furnace being simple in the manufacture, economical in operation, and handy in maintenance.

The objects set forth and other objects of the present invention are attained by that in a plasma-arc furnace comprising a casing with plasma torches mounted therewithin in symmetrical relationship relative to the vertical axis thereof, each of said torches having a body provided with a nozzle and an axial conduit for feeding a plasma-forming gas, and a cylindrical electrode within said conduit for connection to a three-phase power supply, according to the invention, the plasma torches are so mounted that the distance between the centers of working ends of electrodes of adjacent torches is not more than 15 diameters of the electrode.

The investigations have demonstrated that with such a mutual disposition of the plasma torches, their arcs form a unified thermodynamic system allowing energy losses of one arc (in a torch wherein at the given moment the current and the voltage are equal to zero) to be compensated by means of convective and radiation energy of other arcs (in torches wherein the vectors of current and voltage are shifted relative to the same vectors of the first plasma torch by 120° and 240° and at the given moment are not equal to zero).

All the above said may be explained as follows. The maximum amount of energy which can be transmitted by certain arcs (conditionally designated as "burning") to another arc (called "extinguishing") in order to compensate its energetical losses and to inhibit the processes of gas deionization therein, depends directly upon the value of current in these burning arcs and is inversely proportional to a distance between said arcs and an extinguishing one. Thus, the greater the current in the burning arc, the greater is the distance of energy transmission from this arc to the extinguishing one. In the interelectrode space where the extinguishing arc is burning, a required conductivity is achieved and the current is flowing without zero intervals. In other words, with an increase in the strength of current in the arcs the distance between the plasma torches may be increased without the danger of violation of stability of their operation.

Since the strength of arc current is proportional to the diameter of the electrode of the plasma torch, we have chosen said diameter as a parameter determining the maximum distance between the torches (more precisely, between the centers of working ends of electrodes), said distance ensuring stable arc burning.

Arrangement of plasma torches with keeping to the above recommended critical magnitude of the distance between the electrodes thereof is the prerequisite for stable burning of all the plasma arcs, said stability being achieved even with a relatively large length of the arc (in the order of 1 m).

In the case where this distance exceeds 15 diameters of the electrode, the experiments carried out have demonstrated that in an arc wherein at the given moment the current and the voltage are equal to zero, there occurs a considerable dissipation of energy into surrounding space. With such a large distance between the extinguishing arc and the burning ones, the energy inflow to the former from the latter is so small that appears to be insufficient to compensate its energy losses. Due to this fact in the extinguishing arc deionization processes intensively develop, thereby leading to violation of the burning stability thereof.

The minimum magnitude of the distance between the electrodes of adjacent plasma torches is not specified in the disclosure of the present invention since these torches may be brought together up to the contact between their bodies without any deterioration in stability of operation thereof.

BRIEF DESCRIPTION OF DRAWINGS

The present invention will become apparent from specific examples of embodiments thereof with reference to the accompanying drawings, in which.

DETAILED EXPLANATION OF THE INVENTION

Figure 1:
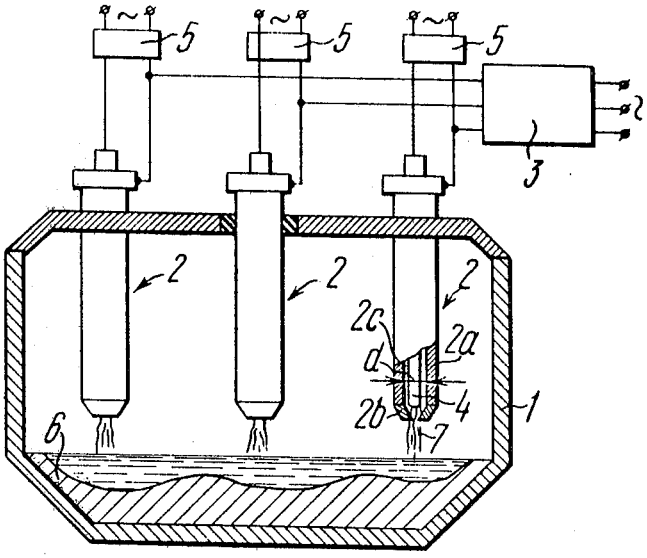
FIG. 1 shows schematically a longitudinal section of the plasma-arc furnace of the invention in the case of vertical arrangement of plasma torches.

The inventive plasma-arc furnace comprises a casing 1 (FIG. 1) and plasma torches 2 mounted therewithin in symmetrical relationship relative to the vertical axis hereof. The number of the torches 2 is selected to be multiple (or equal in the specific case) to the number of three, said torches being energized from a three-phase power supply 3.

Each of the torches 2 comprises a metal body 2*a* provided with a nozzle 2*b* and an axial conduit 2*c* for feeding plasma-forming gas to said torch from a corresponding source (not shown). Within the conduit 2*c* of the torch 2 is disposed a cylindrical electrode 4 being connected to a corresponding phase of said three-phase power supply 3.

For the purpose of ignition of plasma arcs, the furnace is further provided with three (corresponding to the number of the torches 2) ignition devices 5 being, in particular, electric oscillators, each of said oscillators being connected to the electrode 4 and the body 2*a* of a corresponding torch 2. Such oscillators are widely known (see FRG Patent Specifications No. 1,011,095 and No. 1,095,095) and are not described in detail herein. It should be noted that the ignition devices 5 are not obligatory elements of the inventive furnace since the ignition of arcs may be as well accomplished without these devices, e.g. by bringing together the torches 2 being under voltage till there occurs a breakdown of space therebetween and a spark initiated between said torches initiates ignition of arcs, following which the torches 2 are brought apart into the starting position. However, the presence of the devices 5 is rather desirable since said devices upgrade the reliability of initial ignition (start-up) of plasma arcs.

Figure 2:
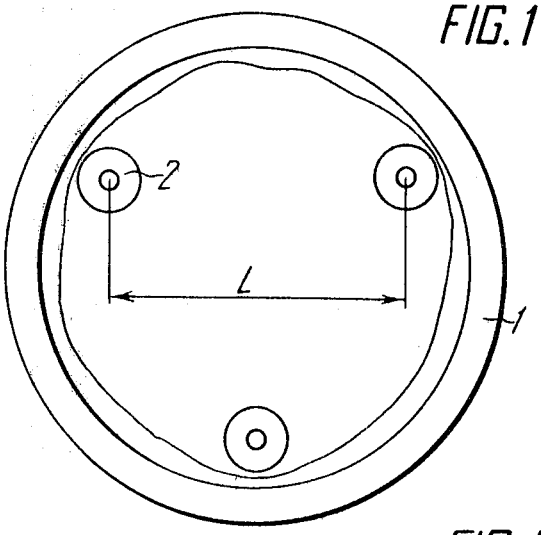
FIG. 2 shows a plan view of the apparatus shown in FIG. 1.
Figure 3:
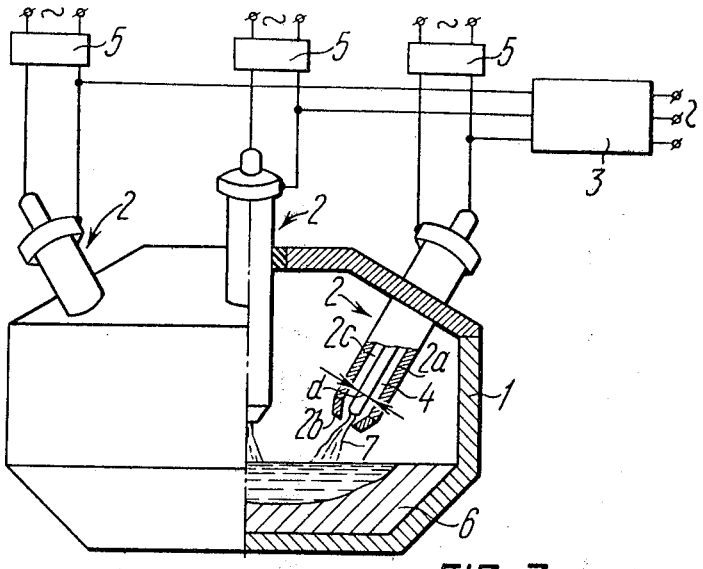
FIG. 3 shows the view of FIG. 1 in the case of arrangement of plasma torches at an angle to one another.
Figure 4:
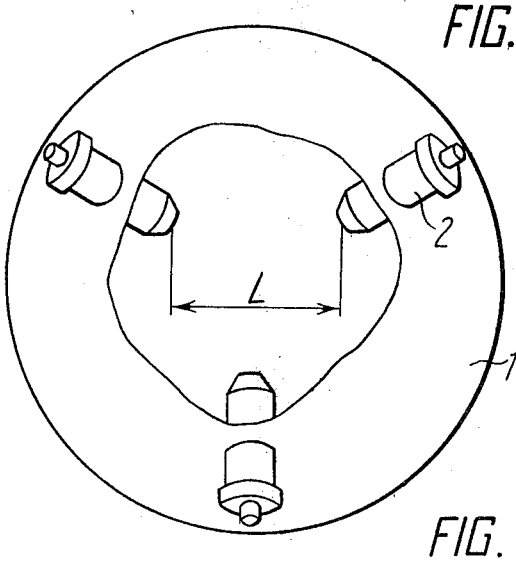
FIG. 4 shows a plan view of the apparatus shown in FIG. 3.

According to the invention, the distance L between the centers of the working ends of the electrodes 4 of adjacent plasma torches 2 (in the case of three torches this distance is taken between any of them) does not exceed 15 diameters d of the electrode 4. In FIGS. 1 and 2, illustrating vertical arrangement of the plasma torches, this distance L coincides with a distance between the axes of the conduits 2*c* of the torches 2. With arrangement of the torches 2 at an angle to one another, as shown in FIGS. 3 and 4, this distance L is measured between the centers of the lower end of the electrodes 4 or between the centers of the ends of the nozzles 2*b*.

Specific value of said distance L is established depending on the kind of process treatment, surface area and shape of metal surface being treated, furnace capacity and power, composition and pressure of gas contained within a melting space, and other factors.

The above described furnace operates as follows. A metal 6 which is to be subjected to plasma heating is charged to the furnace (FIG. 1). Following this, plasma-forming gas, e.g. argon, is supplied into the conduits 2*c* of the plasma torches 2, the three-phase power supply 3 is actuated, and plasma arcs 7 are ignited by means of the ignition devices 5. In the course of operation, the nozzles 2*b* of the torches 2 are cooled with water being supplied from a corresponding source (not shown).

With the above distance between the torches 2 they form a unified thermodynamic system, and the burning of the plasma arcs 7 proceeds in a stable manner since at the moment when current and voltage in one arc reduce to zero, convective and radiation energies of two other arcs wherein current and voltage are not equal to zero at this moment, compensate the energy losses in the first arc to such an extent that deionization processes therein become inhibited, and the conductivity of the column thereof remains sufficiently high to strike an arc during the next half-cycle. Such a stable burning is achieved in all the plasma arcs, thereby providing for effective heating and melting the metal 6 being charged thereto without complicating the furnace design, and at the same time is not accompanied by an increase in the thermal load to the nozzles 2*b* of the torches 2.

While particular embodiments of the invention have been shown and described, various modifications thereof will be apparent to those skilled in the art and therefore it is not intended that the invention be limited to the disclosed embodiments or to the details thereof and the departures may be made therefrom within the spirit and scope of the invention as defined in the appended claims.

What we claim is:

1. A plasma-arc furnace comprising:

a casing, and a plurality of plasma torches, each comprising a body provided with a nozzle and an axial conduit for feeding a plasma-forming gas, and a cylindrical electrode for connection to a three-phase power supply, said electrode being disposed within said conduit of said body; and being mounted within said casing in symmetrical relationship relative to the vertical axis thereof so that the distance between the centers of working ends of said plurality of electrodes of adjacent said torches is not more than 15 diameters of said electrode.

* * * * *